US005248064A

United States Patent [19]

Claycomb, Jr.

[11] Patent Number: 5,248,064

[45] Date of Patent: Sep. 28, 1993

[54] BEVERAGE CONTAINER AND DISPENSING APPARATUS

[76] Inventor: Clayton R. Claycomb, Jr., 10935 Edinger Ave., Fountain Valley, Calif. 92708

[21] Appl. No.: 969,585

[22] Filed: Oct. 30, 1992

[51] Int. Cl.[5] ..... B65D 83/14

[52] U.S. Cl. ..... 222/95; 222/386.5; 222/400.8; 222/401

[58] Field of Search ..... 222/95, 105, 386.5, 222/389, 400.7, 400.8, 401, 209

[56] References Cited

U.S. PATENT DOCUMENTS

| | | | |
|---|---|---|---|
| 1,752,090 | 3/1930 | Johannssen | 222/400.8 |
| 2,223,256 | 11/1940 | Kross | 222/400.8 |
| 2,256,113 | 9/1941 | Gray | 222/400.8 |
| 2,312,067 | 2/1943 | Bates | 222/400.8 X |
| 2,652,952 | 9/1953 | Mowbray | 222/400.8 X |
| 2,710,711 | 6/1955 | Hutton | 222/400.8 |
| 3,127,070 | 3/1964 | Brickman | 222/400.8 X |
| 3,198,405 | 8/1965 | Pfeil | 222/400.8 |
| 3,199,511 | 8/1965 | Kulick | 222/386.5 X |
| 3,207,387 | 9/1965 | Brickman | 222/400.8 |
| 3,662,929 | 5/1972 | Sims | 222/386.5 |
| 4,147,278 | 4/1979 | Uhlig | 222/400.8 X |
| 4,436,227 | 3/1984 | Johnson, Jr. et al. | 222/400.8 X |
| 5,131,569 | 7/1992 | Hodgson | 222/400.8 X |

*Primary Examiner*—Kevin P. Shaver
*Attorney, Agent, or Firm*—Leon Gilden

[57] ABSTRACT

A beverage container includes a bladder mounted to a lid assembly, with the lid assembly having a pump and dispenser conduit structure secure thereto. The bladder when positioned within the container includes a beverage fluid therewithin, whereupon pressurizing of the container about the bladder permits selective dispensing of fluid from the bladder through the container head having a valved exit port.

2 Claims, 4 Drawing Sheets

BEVERAGE CONTAINER AND DISPENSING APPARATUS

BACKGROUND OF THE INVENTION

1. Field of the Invention

The field of invention relates to container structure, and more particularly pertains to a new and improved beverage container and dispensing apparatus wherein the same is arranged to selectively pressurize and dispense fluid from within a bladder structure of an associated container.

2. Description of the Prior Art

Beverages, and particularly carbonated beverages, are arranged for dispensing from a container wherein typically, such as with beer kegs and the like such as indicated in U.S. Pat. No. 3,776,260, the associated beer keg includes a carbonated beverage that typically has a compressed carbon dioxide pressurized source to permit projection of fluid from the container, such as indicated in U.S. Pat. No. 5,016,786.

U.S. Pat. No. 4,801,042 to Hamada sets forth an inner bag for a container functioning as a shield to protect contents from moisture directed into the container.

As such, it may be appreciated there continues to be a need for a new and improved beverage container and dispensing apparatus as set forth by the instant invention which addresses both the problems of ease of use as well as effectiveness in construction in a manner not set forth by the prior art to provide for the selective pressurizing and dispensing of fluid from an associated container and in this respect, the present invention substantially fulfills this need.

SUMMARY OF THE INVENTION

In view of the foregoing disadvantages inherent in the known types of beverage container apparatus now present in the prior art, the present invention provides a beverage container and dispensing apparatus wherein the same is arranged to selectively dispense pressurized fluid from within an associated container employing a self-contained pump structure. As such, the general purpose of the present invention, which will be described subsequently in greater detail, is to provide a new and improved beverage container and dispensing apparatus which has all the advantages of the prior art beverage container apparatus and none of the disadvantages.

To attain this, the present invention provides a beverage container including a bladder mounted to a lid assembly, with the lid assembly having a pump and dispenser conduit structure secured thereto. The bladder when positioned within the container includes a beverage fluid therewithin, whereupon pressurizing of the container about the bladder permits selective dispensing of fluid from the bladder through the container head having a valved exit port.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage container and dispensing apparatus which has all the advantages of the prior art beverage container apparatus and none of the disadvantages.

It is another object of the present invention to provide a new and improved beverage container and dispenser apparatus which may be easily and efficiently manufactured and marketed.

It is a further object of the present invention to provide a new and improved beverage container and dispenser apparatus which is of a durable and reliable construction.

An even further object of the present invention is to provide a new and improved beverage container and dispenser apparatus which is susceptible of a low cost of manufacture with regard to both materials and labor, and which accordingly is then susceptible of low prices of sale to the consuming public, thereby making such beverage container and dispenser apparatus economically available to the buying public.

Still yet another object of the present invention is to provide a new and improved beverage container and dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
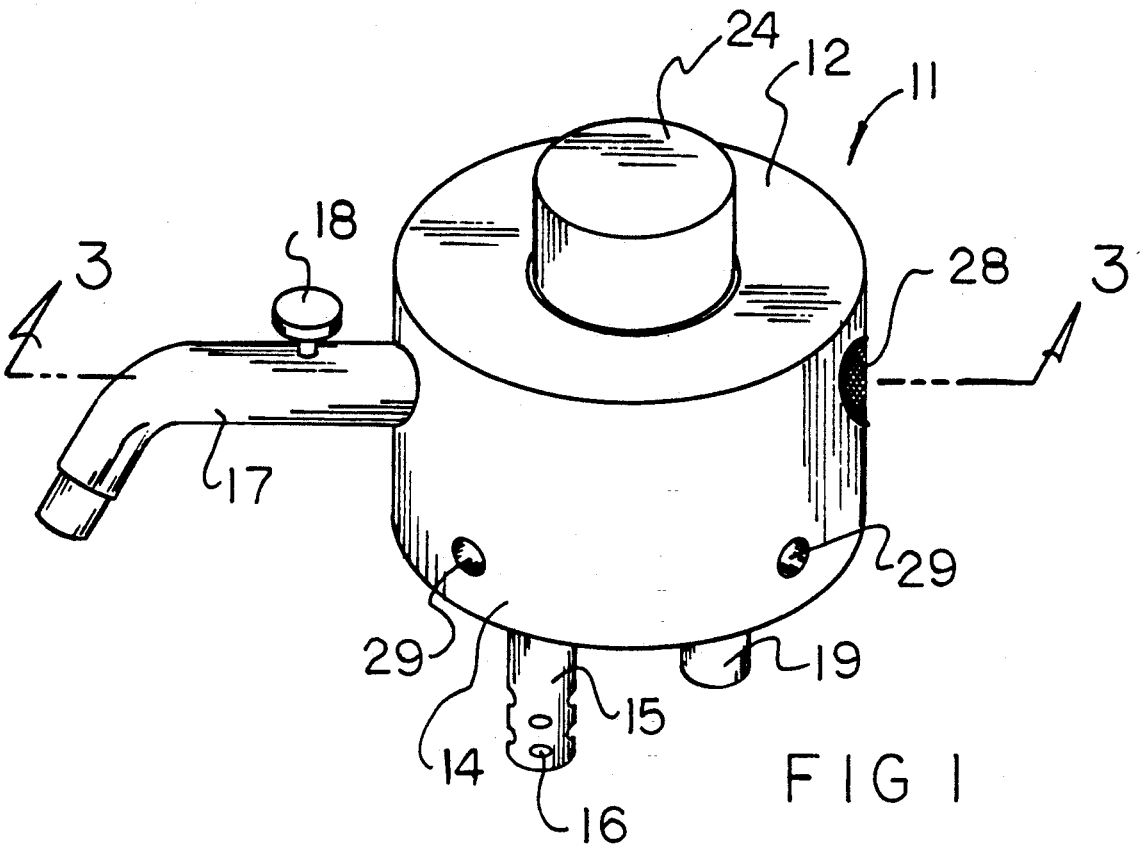
FIG. 1 is an isometric illustration of the container head structure of the invention.
Figure 2:
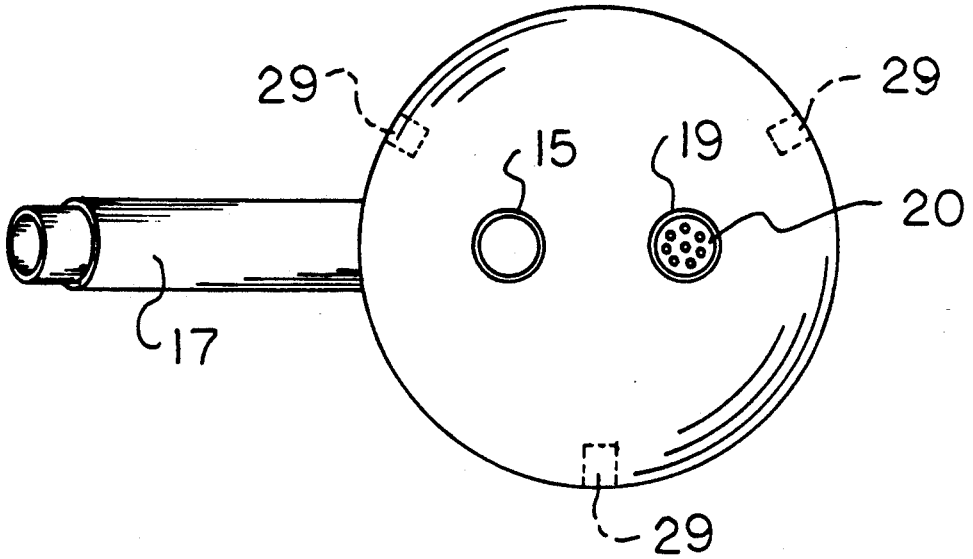
FIG. 2 is an orthographic bottom view of the container head, as indicated in FIG. 1.

With reference now to the drawings, and in particular to FIGS. 1 to 8 thereof, a new and improved beverage container and dispensing apparatus embodying the principles and concepts of the present invention and generally designated by the reference numerals 11–45 will be described.

Figure 8:
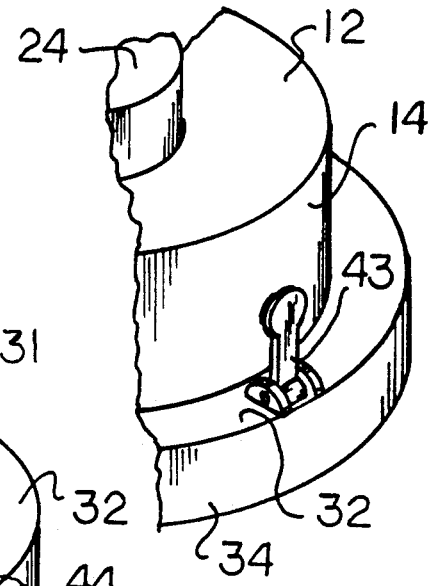
FIG. 8 is a partial isometric view of the container head mounted to the lid assembly.
Figure 7:
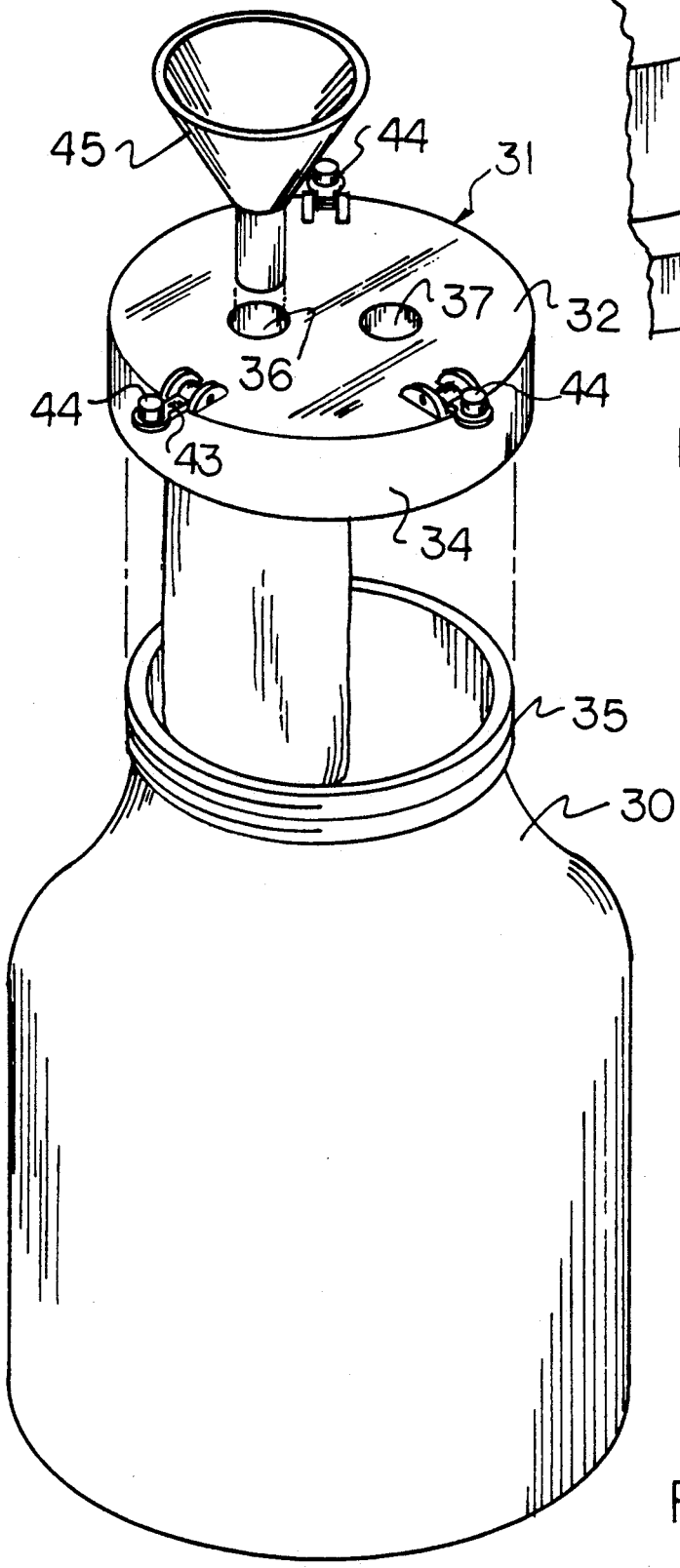
FIG. 7 is an isometric illustration of the lid assembly mounted to an associated container.

More specifically, the beverage container and dispensing apparatus of the instant invention essentially comprises the use of a container head 11, such as indicated in FIG. 1, mounted to a lid assembly 31, as indicated in the FIG. 8, which in turn is secured to an associated storage container 30 (see FIG. 7).

Figure 3:
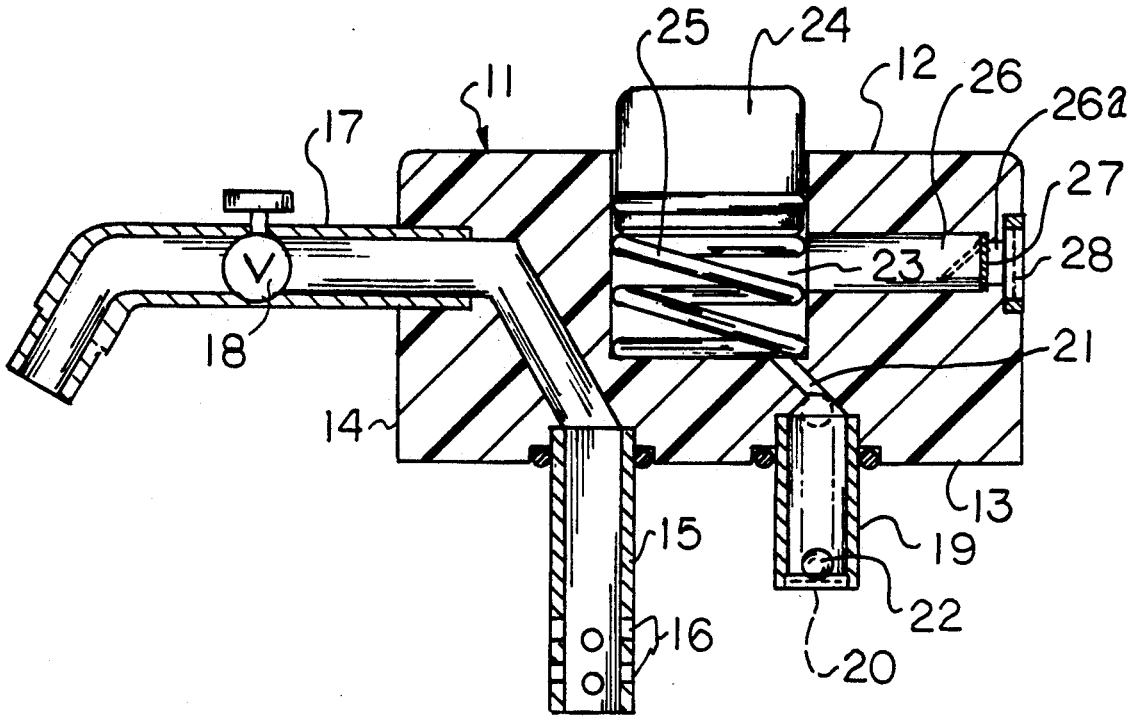
FIG. 3 is an orthographic view, taken along the lines 3—3 of FIG. 1 in the direction indicated by the arrows.
Figure 6:
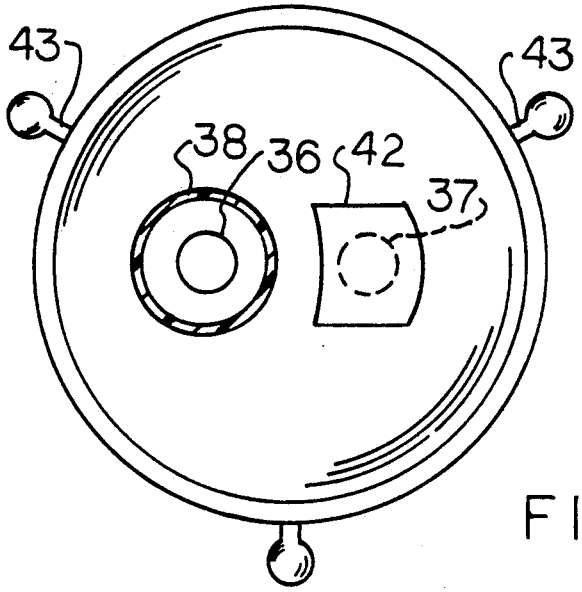
FIG. 6 is an orthographic view, taken along the lines 6—6 of FIG. 5 in the direction indicated by the arrows.
Figure 4:
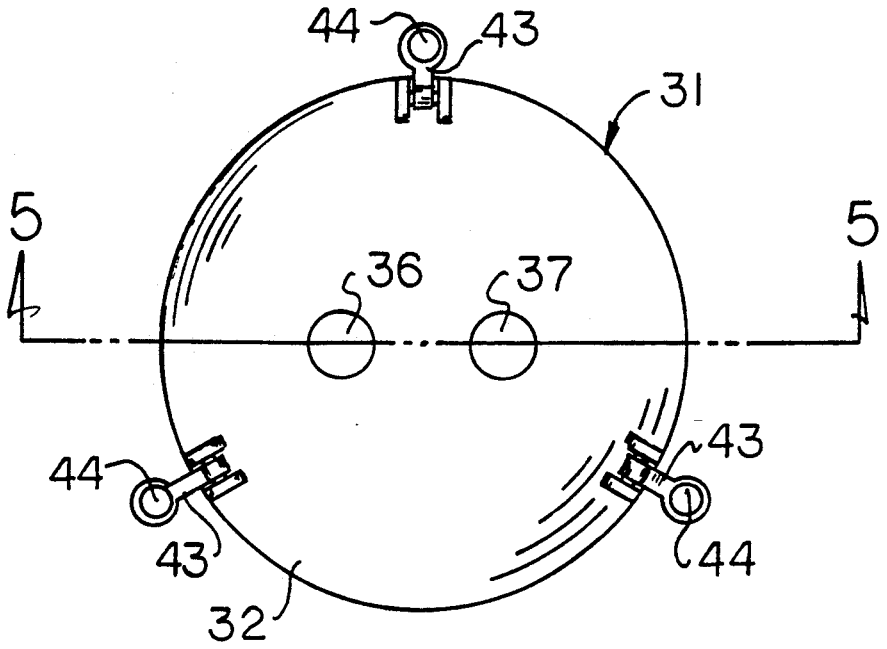
FIG. 4 is an orthographic top view of the lid assembly.
Figure 5:
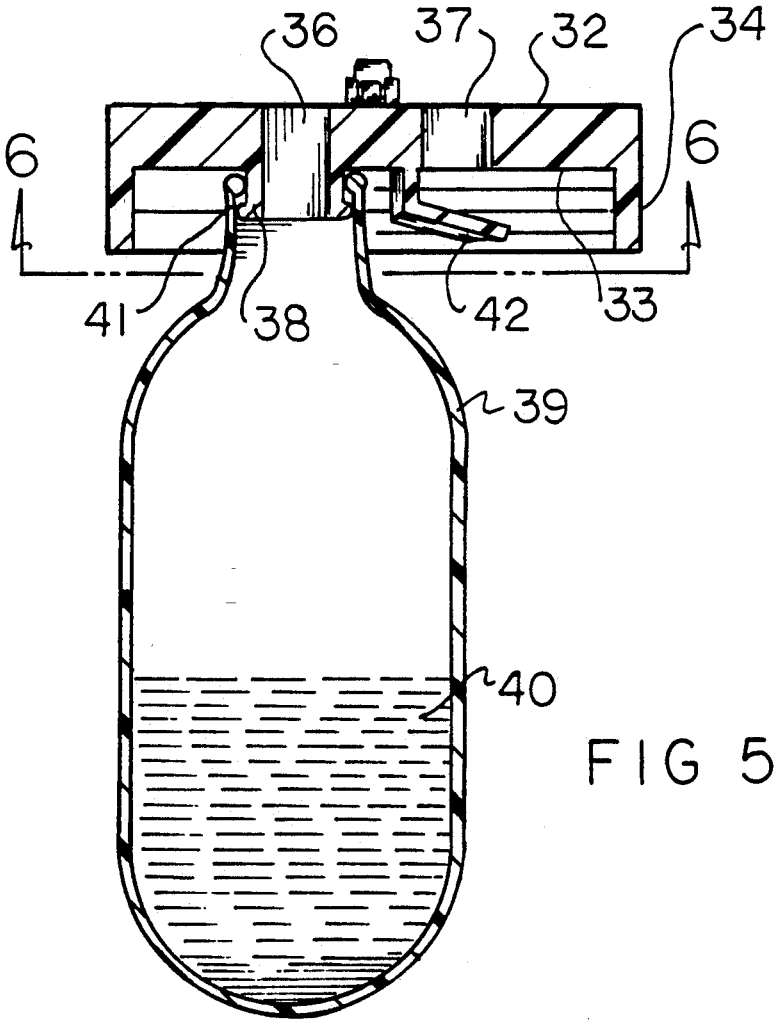
FIG. 5 is an orthographic view, taken along the lines 4—4 of FIG. 4 in the direction indicated by the arrows.

The container head 11 includes a container head top wall 12 spaced from a container head bottom wall 13 having a continuous container head side wall 14. A first conduit 15 projects below the container head bottom wall 13 having a plurality of first conduit entrance apertures 16 directed therein to enhance fluid flow into the first conduit 15. An exit conduit 17 (see FIG. 3) is arranged in fluid communication with the first conduit 15, with an exit conduit valve 18 mounted within the exit conduit 17 to permit selective fluid flow therethrough. A second conduit 19 projects below the bottom wall 13 having an apertured end plate 20 at a lower distal end of the second conduit 19 below the container head bottom wall 13. A second conduit exit conduit 21 is directed from an upper distal end of the second conduit 19 into a plunger cavity 23 that extends from an orientation above the container head bottom wall 13 through the container head top wall 12. A plunger 24 is arranged for reciprocation within the plunger cavity 23 having a plunger spring 25 maintaining the plunger 24 in a raised orientation, such as indicated in FIG. 3. A check ball 22 is arranged to maintain pressure within the container 30, wherein the check ball 22 is prevented from entering the second conduit exit conduit 21 and as the second conduit 19 is pressurized, the check ball 22 is lifted from its first position, as indicated in FIG. 3, resting upon the apertured end plate 20 permitting pressurized air directed therethrough about the check ball to a second raised position, as indicated in phantom in FIG. 3, preventing pressure from exiting through the exit conduit 21 and the associated primary air supply conduit 26. The primary air supply conduit 26 provides air into the plunger cavity 23 and is in pneumatic communication with a secondary air supply conduit 26*a* of a smaller diameter than the primary air supply conduit 26. A valve plate 27 pivotally mounted at an interface of the primary air supply conduit 26 and the second air supply conduit 26*a* closes upon pressurizing within the primary air supply conduit 26. An inlet screen 28 is positioned in the container head side wall 14 filtering air into the primary and secondary air supply conduits. Further it should be noted that a plurality of lock bores 29 are directed into the container head side wall 14 to provide for latching of the lid assembly 31, in a manner to be described in more detail below.

The lid assembly 31 includes a lid assembly top wall 32 spaced from a lid assembly bottom wall 33 having an internally threaded skirt 34 projecting below the bottom wall 33 arranged for threaded engagement and securement to the container 30 having a container externally threaded neck 35, in a manner as indicated in FIG. 7. The lid assembly 31 includes a lid first conduit 36 extending from the lid assembly top wall 32 through the lid assembly bottom wall 33 and projecting therebeyond terminating in a container support flange 38 spaced from the lid assembly bottom wall 33. A lid second conduit 37 is directed through the lid assembly 31 for receiving the container head second conduit 19, with the container head first conduit 15 directed into and received within the lid first conduit 36 and projecting beyond the lid conduit 36 projecting into the associated fluid bladder 39 having a fluid beverage 40 therewithin. In this manner when fully assembled, the container 30 is pressurized pressurizing the bladder 39 that is flexible and deformable directing fluid therefrom through the valve exit conduit 17. A flexible baffle plate 42 is positioned below the lid second conduit 37 that is positioned in adjacency to the bladder 39 to prevent inadvertent puncturing of the bladder 39 when the container head second conduit 19 is directed through the lid second conduit 37.

Lock plates 43 are pivotally mounted to the lid assembly top wall 32, each having a plug 44, with each plug arranged for reception within one the lock bores 29 of the container head 11.

The FIG. 7 indicates the use of a fill funnel 45 directed into the lid first conduit 36 to permit replenishment of the beverage fluid 40 within the bladder 39 prior to mounting the container head 11 onto the lid assembly 31.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage container and dispensing apparatus, comprising, a rigid container having a container neck, and a lid assembly, with the lid assembly including a lid assembly top wall spaced from a lid assembly bottom wall, and a skirt member extending from the bottom wall for securement to the container neck, and a container head arranged for securement to the lid assembly, with the lid assembly having mounting means for securement to the container head, and a first conduit directed through the container head projecting into the lid assembly, and a flexible bladder mounted to the lid assembly adjacent the lid assembly bottom wall, with the first conduit directed into the bladder, and pressurizing means mounted within the container head for directing pneumatic pressure to the first conduit, and the container head having a second conduit, with the second conduit in pneumatic communication with the pressurizing means, and the second conduit directed through the lid assembly into the container positioned exteriorly of the bladder, and the container head includes a container head top wall spaced from a container head bottom wall, and a continuous container head side wall, with a plunger cavity directed into the container head extending from the container head top wall in a spaced relationship relative to the container head bottom wall, and an exit conduit in pneumatic communication between the plunger cavity and the second conduit, the pressurizing means including a plunger mounted reciprocatably within the plunger cavity having a spring mounted between the plunger and a plunger cavity floor of the plunger cavity, and a primary air supply conduit directed into the plunger cavity, the primary air supply conduit having a first diameter, and a secondary air supply conduit directed into the primary air supply conduit having a second diameter less than the first diameter, and the secondary air supply conduit directed through the container head side wall, and a valve plate pivotally mounted within the primary air supply conduit at an interface between the primary air supply conduit and the secondary air supply conduit, and the second conduit having a second conduit lower distal end, the second conduit lower distal end including an apertured plate, and a check ball arranged for displacement between the apertured plate and the second conduit exit conduit preventing pressurizing air from escaping through the exit conduit, and the lid assembly includes a lid first conduit directed therethrough receiving the first conduit to the lid first conduit, and the lid assembly having a lid second conduit slidably receiving the second conduit therethrough, wherein the lid first conduit and the lid second conduit project coextensively from the lid assembly top wall through the lid assembly bottom wall, with the lid first conduit extending beyond the lid assembly bottom wall terminating in a flange member, and the bladder having a bladder neck mounted about the flange member, and a baffle plate of an L-shaped configuration extending from the lid assembly bottom wall over the lid assembly second conduit oriented between the lid second conduit and the bladder tube to prevent inadvertent puncturing of the bladder.

2. An apparatus as set forth in claim 1 wherein the mounting means includes a plurality of lock plates pivotally mounted to the lid assembly top wall adjacent an outer periphery of the lid assembly top wall, and each lock plate having a plug member, and the container head side wall having a plurality of lock bores and each of the plug members arranged for reception within one of the lock bores.

* * * * *